US008919091B2

(12) United States Patent
Stephan et al.

(10) Patent No.: US 8,919,091 B2
(45) Date of Patent: Dec. 30, 2014

(54) SPINNING MACHINE AND METHOD FOR INTERRUPTING YARN PRODUCTION ON A SPINNING MACHINE

(75) Inventors: Adalbert Stephan, Beilngries (DE); Gernot Schäffler, Wäschenbeuren (DE); Evzen Pilar, Litomysl (CZ); Martin Novak, Usti nad Orlici (CZ); Vítezslav Kubes, Usti nad Orlici (CZ); Josef Ludvícek, Usti nad Orlici (CZ); Vladimir Krycner, Usti nad Orlici (CZ)

(73) Assignee: Rieter Ingolstadt GmbH, Ingolstadt (DE)

( * ) Notice: Subject to any disclaimer, the term of this patent is extended or adjusted under 35 U.S.C. 154(b) by 124 days.

(21) Appl. No.: 13/616,791

(22) Filed: Sep. 14, 2012

(65) Prior Publication Data

US 2013/0067880 A1 Mar. 21, 2013

(30) Foreign Application Priority Data

Sep. 21, 2011 (DE) ..... 10 2011 053 812

(51) Int. Cl.
*D01H 4/50* (2006.01)
*D01H 1/24* (2006.01)
*D01H 13/14* (2006.01)

(52) U.S. Cl.
CPC . *D01H 1/24* (2013.01); *D01H 4/50* (2013.01); *D01H 13/14* (2013.01)
USPC ..... 57/78

(58) Field of Classification Search
USPC ..... 57/22, 78, 202, 261, 263, 264, 350
See application file for complete search history.

(56) References Cited

U.S. PATENT DOCUMENTS

| | | | | |
|---|---|---|---|---|
| 3,501,905 | A | 3/1970 | Landwehrkamp et al. | |
| 4,638,625 | A | 1/1987 | Lovas et al. | |
| 4,845,936 | A * | 7/1989 | Artzt et al. | 57/261 |
| 4,944,145 | A * | 7/1990 | Stahlecker | 57/261 |
| 5,163,279 | A * | 11/1992 | Stahlecker | 57/86 |
| 5,167,114 | A * | 12/1992 | Stahlecker | 57/261 |
| 5,327,712 | A * | 7/1994 | Dallmann et al. | 57/22 |
| 5,484,116 | A * | 1/1996 | Horak et al. | 242/475.6 |
| 7,464,529 | B2 * | 12/2008 | Stahlecker et al. | 57/263 |
| 2013/0067878 | A1 * | 3/2013 | Stephan et al. | 57/78 |

FOREIGN PATENT DOCUMENTS

| | | |
|---|---|---|
| CH | 436 057 | 11/1967 |
| DE | 10 2007 009 074 A1 | 8/2008 |

OTHER PUBLICATIONS

German Patent Office Search Report, Mar. 15, 2012.

* cited by examiner

*Primary Examiner* — Shaun R Hurley
(74) *Attorney, Agent, or Firm* — Dority & Manning, P.A.

(57) ABSTRACT

A method is provided for interrupting yarn production on a spinning machine upon detecting a defined deviation of a monitored yarn parameter from a target value, upon changing bobbins at a winding device, and/or prior to switching off the spinning machine. The feed speeds of the delivery device, the take-off device, and the winding device are gradually reduced to a stop in order to interrupt the yarn production, wherein the reducing takes place such that an end of the produced yarn is located within the spinning point after the reducing is completed.

15 Claims, 2 Drawing Sheets

SPINNING MACHINE AND METHOD FOR INTERRUPTING YARN PRODUCTION ON A SPINNING MACHINE

BACKGROUND

In general, for example, stopping the spinning process in the case of a detected yarn defect by interrupting fiber infeed is known, for example for rotor or air-jet spinning machines. The end of the yarn on the winding side is then wound up by the bobbin continuing to turn, while the cut end of the yarn is drawn off by vacuum. When spinning is subsequently restarted by piecing, the end of the yarn on the bobbin must then be detached from the surface of the bobbin, such as by means of a corresponding suction device, in order to be able to feed it back against the actual spinning direction to the spinning point again. Locating the end of the yarn is, however, typically very time-consuming and is also afflicted by a mechanical effect, particularly for very fine and highly spun yarns, so that the process of piecing can lead to a significant delay in continuing the spinning process.

An object of the present invention is therefore to accelerate the piecing process after a controlled interruption of yarn production.

SUMMARY

Additional objects and advantages of the invention will be set forth in part in the following description, or may be obvious from the description, or may be learned through practice of the invention.

The invention relates to a method for interrupting yarn production on a spinning machine, wherein the spinning machine includes at least one spinning point having an inlet for a fiber material and an outlet for the yarn made from the fiber material. The spinning machine includes a delivery device for feeding the fiber material into the spinning point, a take-off device for drawing off the yarn out of the spinning point, a winding device for winding up the produced yarn, and a yarn monitoring unit for monitoring at least one yarn parameter (such as in the form of the yarn thickness or another parameter representative of the quality of the yarn). Yarn production is interrupted upon detecting a defined deviation of the monitored yarn parameter from a target value, upon changing bobbins at the winding device, and/or prior to switching off the spinning machine.

The invention further relates to a spinning machine for producing a yarn, wherein the spinning machine comprises at least one spinning point having an inlet for a fiber material and an outlet for the yarn produced from the fiber material, and wherein the spinning machine comprises a delivery device for feeding the fiber material into the spinning point, a take-off device for drawing off the yarn from the spinning point, a winding device for winding up the produced yarn, and a yarn monitoring unit for monitoring at least one yarn parameter.

According to the invention, the method is characterized in that the feed speeds of the delivery device, the take-off device, and the winding device are gradually reduced to a stop in order to interrupt the yarn production, wherein the reducing takes place such that the end of the produced yarn is located within the spinning point after the reducing is completed. In contrast to the method described above, wherein the end of the produced yarn is inevitably wound onto the bobbin until spinning is stopped, because the bobbin cannot be stopped abruptly due to the inertia thereof, such winding can be effectively prevented by the method according to the invention.

The operated spinning machine is preferably an air-jet or rotor spinning machine. Both types of spinning machine are characterized in that particular conditions must be maintained with respect to the feed speed of the delivery device and take-off device. Said speeds must exceed particular threshold values for producing a high-quality yarn, in order to be able to impose the desired twist of the fiber material in the interior of the spinning chamber. If the indicated feed speeds are reduced gradually, that is, preferably within a few seconds, then ultimately the point is reached at which no more yarn production takes place, because either too little fiber material is transported into the spinning chamber, or the yarn is drawn off from the spinning chamber too fast relative to the delivery of the fiber material. At this point in time, an end of the yarn is ultimately produced and moves according to the residual feed speed of the take-off device in the direction of the winding device.

According to the invention, the feed speeds are ultimately reduced to zero in the course of interrupting the yarn production, such that the yarn end is located within the spinning point after the individual feed devices have stopped. The yarn formation within the spinning point is thus interrupted gradually, and thus not abruptly, reducing the individual feed speeds. The corresponding end of the yarn is thus produced by correspondingly matching the individual feed speeds. The yarn production is thereby interrupted so that the yarn detaches from the subsequent fiber material. It may be necessary for complete detachment of the yarn to briefly accelerate or to more intensely brake the delivery device and/or the take-off device, particularly during the reduction of the corresponding feed speeds, in order bring about complete detachment of the yarn. Because the feed speeds at this point are significantly lower than during the actual yarn production, the winding device can also be slowed at a targeted rate, so that a defined end state arises wherein the end of the yarn is located at the described position, and thus not on the surface of a corresponding bobbin of the winding device. In order to ensure uniform winding of the produced yarn on the bobbin even at reduced feed speeds, it can also be useful to slow down (or to stop in the middle) any device for guiding the yarn. The end of the yarn can then be moved to the corresponding location intended for piecing, without requiring a prior search process on the bobbin surface for finding the end of the yarn. Similarly, the above applies to rotor spinning machines as well, wherein the yarn production is also interrupted if the corresponding feed speeds fall below particular threshold values It is further advantageous if the delivery device is formed by a pair of delivery rollers and/or the take-off device is formed by a pair of take-off rollers. Such rollers allow precise control of the corresponding feed speeds by adjusting the rotary speeds thereof accordingly. The rotary speeds can thus be reduced within a prescribed time span in the course of the method according to the invention, typically between one and a plurality of seconds, without causing the yarn to tear.

It is further advantageous if the spinning point includes a vortex chamber and a hollow spindle protruding into the vortex chamber, through which the produced yarn is drawn off out of the vortex chamber in the direction of the outlet of the spinning point during yarn production, and that the reducing of the feed speeds takes place such that the end of the produced yarn is located within the spinning jet after the reducing is complete. In this case, the end of the yarn no longer has to be threaded into the spinning jet opposite the actual spinning direction, so that a large portion of the thread handling and thread guiding tasks that are required in the state of the art prior to the piecing process are no longer necessary.

The end of the yarn must thus be displaced (e.g., pushed or sucked) opposite the spinning direction only far enough that the end of yarn, optionally prepared for the piecing process in an intermediate step, can be brought into contact with the subsequent fiber material. The actual piecing process, that is, the connection of the fiber material and the end of the yarn, can then be performed in the conventional manner.

It is further very advantageous if the feed speeds are reduced continuously, preferably linearly. Abrupt changes in speed and potential tearing of the yarn are thereby avoided. In addition to a linear reduction in speed, any other arbitrary reduction is also conceivable, of course. Even if it is entirely possible to reduce the feed speeds of the delivery device and the take-off device simultaneously, and to stop said devices at the same point in time, it has been found to be advantageous to reduce the corresponding feed speeds at staggered times. For example, it is advantageous to reduce the feed speed of the delivery device prior to reducing the feed speed of the take-off device. It is further advantageous to stop the take-off device after stopping the delivery device in order to ensure that the end of the produced yarn is located at the location of the spinning machine according to the invention. As a result, it is therefore advantageous if the drives of the delivery device and the take-off device can be actuated separately.

It should also be noted here that in general it can be advantageous to change the air pressure in the spinning point (or in individual areas thereof) or to change the air pressure of the introduced air, during or even before interrupting the yarn production, in order to adapt the pressure ratios to the corresponding feed speeds. For example, in the case of an air-jet spinning machine, it would be conceivable to reduce (or increase) the air pressure of the air being introduced into the vortex chamber of the corresponding spinning point during the interruption of yarn production, relative to the pressure during yarn production. The vacuum present within spinning chamber enclosing the spinning rotor during yarn production can also be changed correspondingly during or even before the interruption of yarn production, in order to prevent excessive winding up of the yarn end present in the spinning chamber.

It is further advantageous if the take-off device comes to a stop after the delivery device. A defined distance thus arises between the end of the yarn and the previously stopped fiber material after yarn production is interrupted, whereby it can be prevented, in the case of an air-jet spinning machine, that fiber material enters the spinning jet along with the end of the yarn. A defined end of the yarn, clearly separated from the fiber material, is thus obtained and is then available for the piecing process.

It is further advantageous if the yarn is fixed by means of a yarn storage after the reducing of the feed speeds is complete. A yarn storage comprises, for example, a hollow cylinder connected to a vacuum source such that a vacuum can be generated in the hollow cylinder as needed (for example by applying the vacuum source in a target manner.) If the take-off device is stopped later than the winding device, then yarn drawn off from the spinning point after the winding device has stopped can be sucked into the hollow cylinder and thus retained at a defined position, wherein precisely enough yarn is sucked in so that the end of the yarn is positioned at the position according to the invention within the spinning point. After yarn production has been interrupted, the piecing process starts, wherein the end of the yarn must thereby generally be displaced opposite the actual spinning direction in order to be able to be gripped by a service robot performing the piecing process. Alternatively or in addition to fixing by means of the yarn storage, of course, other fixing devices, such as a gripper device, can also be used.

It is further advantageous if the take-off device comes to a stop after the winding device. It is thereby possible, for example, that the segment of the yarn produced during the reducing of the feed speeds is not wound up onto the bobbin of the winding device. If the segment is then to be removed prior to the piecing process, then a corresponding unwinding from the bobbin is no longer necessary. Rather, it would be conceivable, for example, for the segment to be stored intermediately within a separate yarn storage and to be removed prior to the actual piecing process.

It can, however, also be advantageous if the take-off device and the winding device come to a stop at the same time. In this case, the yarn then runs from the spinning point to the winding device without being deflected. It is therefore helpful for the piecing process to operate the take-off device and the winding device at first such that the end of the yarn is displaced opposite the actual spinning direction. If the end of the yarn is then located outside of the spinning point or the twist generating means of the same (e.g., outside of the spinning jet of an air-jet spinning machine), then the piecing process can then be started.

It is further advantageous if the yarn is fixed by means of the take-off device after reducing the feed speeds. If the take-off device is corresponding take-off rollers, then the yarn can be reliably clamped between the corresponding rollers. To this end, it is necessary only to stop the take-off rollers as soon as the end of the yarn is located within the spinning point. If the end of the yarn is captured manually or automatically for piecing, then the clamping is relieved and the end of the yarn is released again, wherein prior to the release a (renewed) defined transport of the end of the yarn by the take-off rollers can take place in or opposite to the spinning direction.

It is particularly advantageous if the end of the produced yarn moves within an area between the inlet of the spinning point and the delivery device or in an area between the delivery device and a roller pair of a drawing unit after interrupting yarn production, and is then connected to the fiber material during a piecing process. To this end, the robot comprises corresponding yarn handling devices, such as a gripper device and/or corresponding suction or blowing devices, in order to guide the end of the yarn opposite to the actual spinning direction to the area where the actual piecing process is to take place, which can also be performed by means of the robot. It is, of course, also possible to equip the individual spinning points with individual yarn handling devices each separately associated with the spinning points, so that the use of a robot may not be necessary. It is ultimately also conceivable that the end of the produced yarn is not connected to the fiber material fed into the spinning point in the course of a piecing process, but rather used for forming a fixed end of the thread (wherein the end of the yarn is placed at a particular location on the full bobbin, typically at the side edge thereof.) In order to make accidental release of the correspondingly placed end of the yarn more difficult during bobbin transport, the yarn can be unwound from the full bobbin by a certain amount prior to placement. The unwound segment is then wrapped around the previously non-wound side part of the bobbin core several times and then fed back to the bobbin surface and placed to the side there.

It is further advantageous if the piecing process takes place outside of the spinning point, particularly between the delivery device and a roller pair of a drawing unit. In this area, the fiber material to be spun is typically fixed by means of corresponding delivery rollers, or in the case of an air-jet spinning machine, by means of a roller pair of a drawing unit connected upstream, after the delivery device has been stopped. Because contact between the fiber material and the returned end of the yarn must be accomplished when piecing, it is thus convenient to perform the piecing process in the area.

It is advantageous if at least the yarn segment produced during the reduction of the feed speeds is removed prior to the piecing process. As a rule, the yarn that is produced during the reduction of the individual feed speeds will namely be of lower quality. If the interruption of yarn production takes place due to the detection of a yarn defect, then it should also be ensured that the segment comprising the yarn defect detected by the monitoring unit is also removed. The length of the yarn segment to be removed in this case therefore corresponds to at least the length of the yarn present between the produced end of the yarn and the yarn defect after the interruption of yarn production. It can then be necessary for removal to operate the winding device prior to piecing such that the yarn already wound on the bobbin is unwound until the bobbin contains only yarn that was produced prior to the reduction in the feed speeds (or prior to the occurrence of the yarn defect.) It would also be possible to accumulate the lower-quality yarn in the yarn storage described above and to cut it off prior to the piecing process. A separate cutting device can be used to this end, for example. It is also noted that it can also be advantageous if a relatively thick yarn is produced immediately prior to the interruption of yarn production according to the invention. The yarn can then be found and/or captured particularly quickly and reliably by the robot.

It can be further advantageous if the reduction of the feed speeds takes place as a function of physical and/or chemical properties of the fiber material (type of fiber material, strength, fiber length, etc.) and/or characteristic parameters of the spinning machine, in order to be able to optimize for particular conditions. The characteristic parameters of the spinning machine can thereby include rotary speeds, delivery speeds, or corresponding parameters of the drawing unit in use. Humidity and/or temperature values at defined locations of the spinning machine or in the rooms around the spinning machine can also be taken into consideration.

Not least, it is advantageous if the end of the produced yarn is retained within the spinning point, particularly by means of a vacuum source, after the reducing of the feed speeds is complete. The retaining or fixing of the end of the yarn has the advantage that the end remains in the desired position until the next process step of the piecing process (which can also be monitored by means of a sensor if needed.)

The spinning machine according to the invention is ultimately characterized in that the machine comprises a control and/or regulation unit designed for operating the spinning machine in accordance with one or more aspects of the preceding description, wherein the interruption of yarn production can take place at individual spinning points or at all spinning points of the spinning machine in the manner according to the invention. With respect to each of the advantages and potential variations, reference is made to the previous description.

Ultimately, further method steps or characteristics of the spinning machine can be implemented, resulting in an advantageous delineation from the known state of the art.

It would be conceivable, for example, that in case of a yarn break (that is, an interruption of the spinning process that was initiated in a controlled or uncontrolled manner), yarn handling devices would be used that can grip the end of the yarn that may have been wound up on the bobbin of the corresponding winding device and can feed the end of the yarn to the subsequent piecing process. The yarn handling devices can thereby be part of a service robot patrolling between the corresponding spinning points, or can be individually associated with each spinning point. It is also conceivable to equip the individual spinning points with corresponding yarn handling devices and nevertheless to use one or more service robots in order to thereby achieve a certain level of work distribution.

A further potential for optimizing the method according to the invention or the described spinning machine can be achieved in that the method for interrupting the yarn production is implemented to be "self-teaching." It would be conceivable, for example, that individual parameters (amount and start of the reduction of the corresponding speeds, time of stopping the delivery device, the take-off device, and/or the winding device, characteristic parameters of the piecing process, etc.) are adapted as a function of the data provided by the corresponding sensors in a preferably continuous process performed by the control and/or regulation device of the spinning machine.

BRIEF DESCRIPTION OF THE DRAWINGS

Further advantages of the invention are described in the following implementation examples. They show.

DETAILED DESCRIPTION

Figure 1:
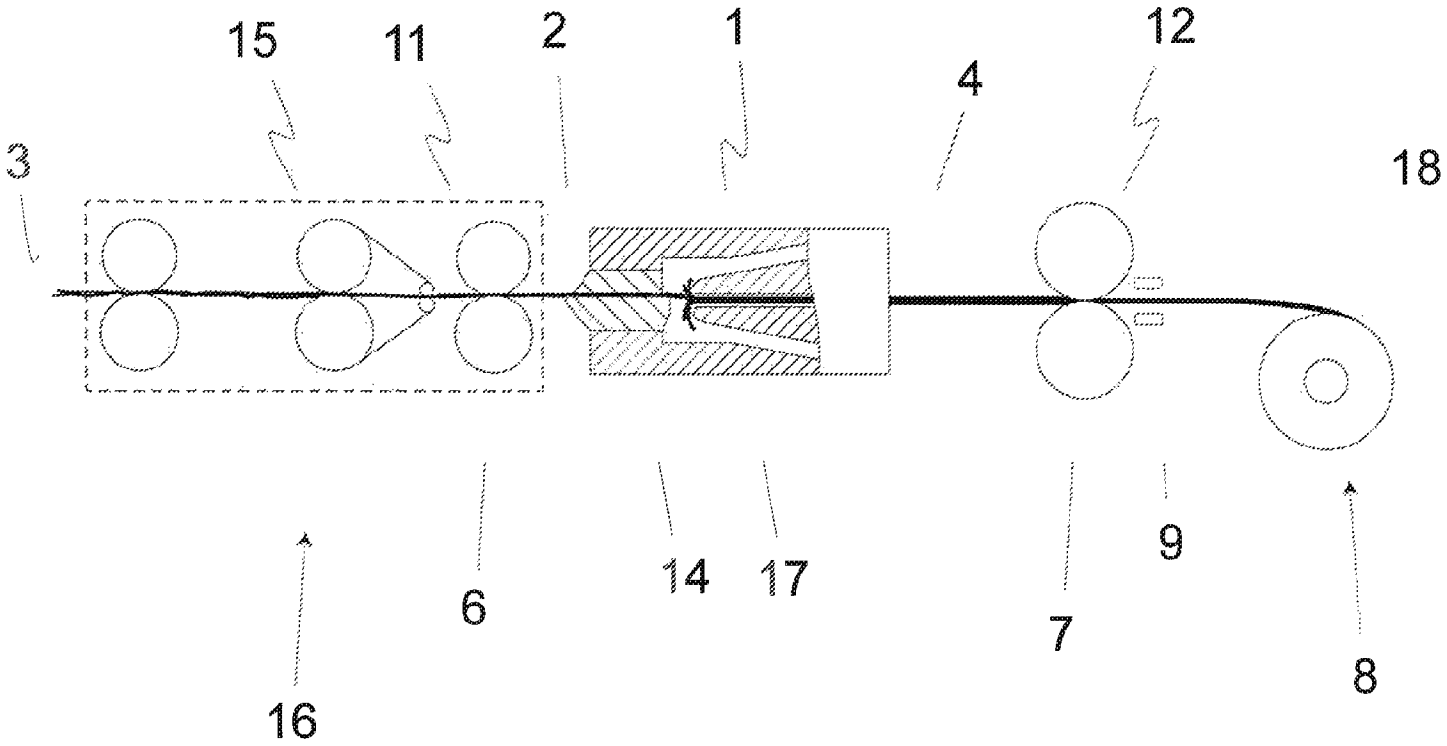
FIG. 1 a side view of a segment of a spinning machine according to the invention during yarn production, and FIG. 2 a side view of a segment of a spinning machine according to the invention after interruption of yarn production.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic view of a segment of an air-jet spinning machine according to the invention. The air-jet spinning machine generally comprises a drawing unit 16 supplied with a fiber material 3, such as in the form of a doubled sliver. The air-jet spinning machine shown further comprises in principle a spinning point 1 spaced apart from the drawing unit 16 and having an inlet 2 for the fiber material 3 and an internal vortex chamber 14.

The fiber material 3 is introduced into the spinning point 1 by means of a delivery device 6 implemented as a delivery roller pair 11, which in turn can be part of the drawing unit 16. The fiber material 3 or at least part of the fibers of the fiber material 3 are provided with a rotation within the vortex chamber 14 for producing the desired yarn 5. The rotation thereby arises from the targeted air flow in the area of a spindle 17, wherein the air flow is generated by nozzles, not shown, opening tangentially into the vortex chamber 14.

The spinning machine shown further comprises a take-off device 7 formed by a take-off roller pair 12 and a winding device 8 connected downstream of the take-off roller pair 12 for the yarn 5 drawn off out of the spinning point 1 through the outlet 4.

The spinning machine is finally equipped with a yarn monitoring unit 9 monitoring previously defined parameters of the yarn 5 (such as the yarn thickness, yarn strength, or other parameters representative of the quality of the yarn 5.) The yarn monitoring unit 9 thereby operates preferably in a non-contacting manner.

The device according to the invention need not necessarily comprise a drawing unit 16 as is shown in FIG. 1. The take-off roller pair 12 is also not absolutely necessary. The spinning machine according to the invention can also be implemented as a rotor spinning machine, wherein the spinning point 1 in this case comprises a rotor in place of the spindle 17 shown, by which the yarn 5 produced at the tip of the spindle 17 is drawn off out of the spinning point 1.

Figure 2:
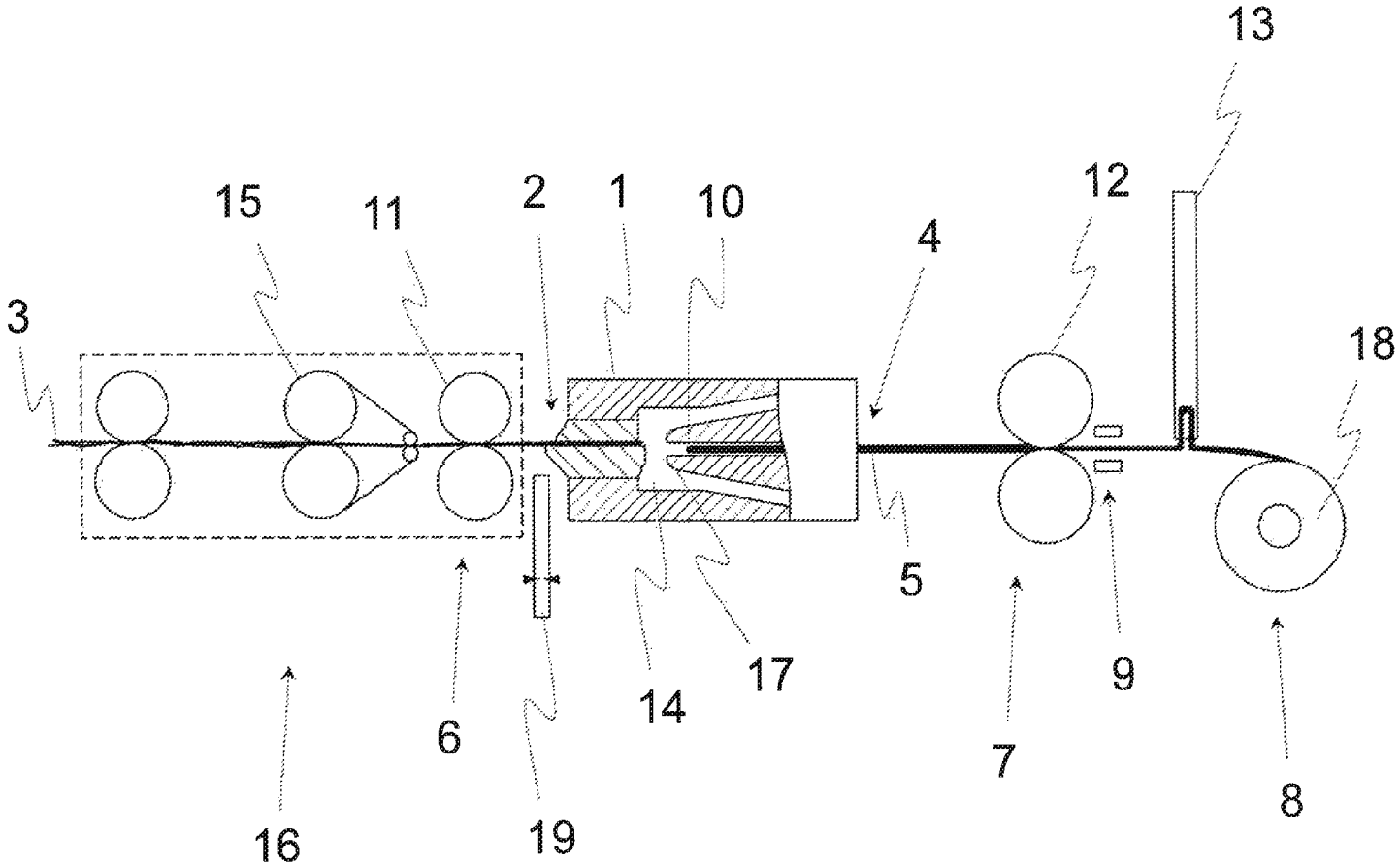

The method according to the invention for interrupting the yarn production can be seen in the combination of FIGS. 1 and 2. FIG. 1 first shows the route of the fiber material 3 and the yarn 5 produced in the area of the spindle 17 during the actual spinning process.

If a defined deviation of the monitored parameter or parameters from corresponding target values is detected by means of the yarn monitoring unit 9 (which can also be located at a different position), or if a bobbin change is imminent, then the feed speeds of the delivery device 6, the take-off device 7, and the winding device 8 are gradually reduced. The reduction can also take place before the spinning machine is switched off.

The reduction does not have to be simultaneous or continuous. In any case, the corresponding feed speeds should be reduced, however, such that the spinning process can be maintained for as long as possible. Tearing of the yarn 5, as is typical for the state of the art, can be prevented in this manner. The goal of reducing the feed speeds, rather, is that the stable spinning process collapses when the speed drops below defined feed speeds, and no more yarn 5 is produced from the fiber material 3 after a particular point in time. At said point in time, the desired interruption of yarn production occurs, wherein the yarn is released from the yarn 5 without a separate application of force. This can be achieved, for example, in that the feed speed of the delivery device 6 is reduced until the amount of fiber material 3 being delivered is not sufficient for making yarn 5 out of said fiber material. It is also possible to reduce the feed speed of the take-off roller pair 12 more slowly (or if needed, also more quickly) than the feed speed of the delivery roller pair 11 and/or the winding device 8.

After the yarn production has been interrupted, it is then possible to operate the take-off roller pair 12 further for a brief period of time, until the resulting end 10 of the yarn 5 reaches a position as shown in FIG. 2, after the final stop of the delivery device 6, the take-off device 7, and the winding device 8. Part of the produced yarn 5 can thereby be retained in a yarn storage 13 (such as in the form of a tube connected to a vacuum source) shown only in FIG. 2, in order to prevent the yarn 5 produced during the reduction of the feed speeds from being wound up on the winding device 8 (the yarn storage 13 is of course not shown to scale, but only schematically.)

As a result, the end 10 of the yarn 5 required for the piecing process is located at a defined position within the spinning point 1, so that the piecing process can be started without previously having to search for the end 10 of the yarn 5, such as on the surface of a bobbin 18 of the winding device 8 (as is typical in the state of the art.)

For the piecing process, the end 10 of the yarn 5 is then pushed opposite the actual spinning direction into the vortex chamber 14, between the inlet 2 of the spinning point 1 and the delivery device 6 or between the delivery device 6 and an adjacent roller pair 15 of the drawing unit 16 by means of a service robot, by means of a yarn handling device dedicated to the spinning point, or manually. There, the end can be brought into contact with the fiber material 3 and fed back into the spinning point 1. The spinning process then starts again from the beginning.

The yarn 5 can thus be fixed by means of the take-off roller pair 12 after interrupting yarn production, as is also shown in FIGS. 1 and 2, in addition to or alternatively to the yarn storage 13. Said step can also serve to displace the end 10 of the yarn 5 opposite the spinning direction by means of a change in direction prior to piecing. A cutting and/or disposal device 19 can also be disposed between the drawing unit 16 and the spinning point 1, or at the spinning point 1 itself, by means of which the end 10 of the yarn 5 can be corresponding prepared prior to piecing. As a rule, a part of the yarn 5 is thereby cut off and disposed of by means of the cutting and/or disposal device 19 using a vacuum, said device also functioning as a draw-off device in this case.

The invention is also not limited to the embodiments shown. Rather, any and all combinations of the individual features described, as shown in the figures or described in the claims or description, and to the extent that a corresponding combination appears possible and sensible, are subject matters of the invention.

The invention claimed is:

1. A method for interrupting yarn production on a spinning machine, wherein the spinning machine includes:

a spinning point having an inlet for fiber material;

an outlet for yarn made from the fiber material;

a delivery device for feeding the fiber material into the spinning point;

a take-off device for drawing off the yarn out of the spinning point;

a winding device for winding up the produced yarn; and a yarn monitoring unit configured to monitor at least one yarn parameter of the produced yarn;

the method comprising:

interrupting yarn production upon detection by the yarn monitor of a defined deviation of the monitored yarn parameter from a target value, upon changing bobbins at the winding device, or prior to switching off the spinning machine;

for the interruption of yarn production, reducing the speed of the delivery device, the take-off device, and the winding device all to a stop; and controlling the reduction of the delivery device, take-off device, and winding device such that an end of the produced yarn is located within the spinning point after the reductions are complete.

2. The method as in claim 1, wherein the delivery device is defined by a delivery roller pair, and the take-off device is defined by a take-off roller pair, wherein reducing the feed speed of the delivery device comprises reducing the speed of the delivery roller pair, and reducing the rate of the take-off device comprises reducing the speed of the take-off roller pair.

3. The method as in claim 1, wherein the spinning point includes a hollow spindle protruding into a vortex chamber, the produced yarn being drawn out through the hollow spindle in the direction of the outlet during yarn production, wherein the reduction of the delivery device, the take-off device, and the winding device is controlled such that the end of the produced yarn is located with the hollow spindle after the reductions are complete.

4. The method as in claim 1, wherein the reduction of the delivery device, the take-off device, and the winding device is reduced in a continuous linear manner.

5. The method as in claim 1, wherein the take-off device is brought to a stop after the delivery device.

6. The method as in claim 1, further comprising fixing a portion of the produced yarn in a yarn storage device after the reductions are complete.

7. The method as in claim 1, wherein the take-off device is brought to a stop after the winding device.

8. The method as in claim 1, wherein the take-off device and the winding device are brought to a stop at the same time.

9. The method as in claim 1, further comprising fixing the produced yarn with the take-off device after the reductions are complete.

10. The method as in claim 1, further comprising moving the end of the produced yarn into an area between the inlet of the spinning point and the delivery device or between the delivery device and a roller pair of a drawing unit upstream of the delivery device after interruption of yarn production, and subsequently connecting the end of the produced yarn to the fiber material during a piecing process.

11. The method as in claim 10, wherein the piecing process takes place outside of the spinning point between the delivery device and the roller pair of the drawing unit.

12. The method as in claim 10, further comprising removing a segment of the produced yarn that was produced during the reductions prior to the piecing process.

13. The method as in claim 1, wherein the reductions are controlled as a function of a physical or chemical property of the fiber material.

14. The method as in claim 1, further comprising retaining the end of the produced yarn within the spinning point with a vacuum source after the reductions are complete.

15. A spinning machine, comprising:

a spinning point having an inlet for fiber material;

an outlet for yarn made from the fiber material;

a delivery device for feeding the fiber material into the spinning point;

a take-off device for drawing off the yarn out of the spinning point;

a winding device for winding up the produced yarn;

a yarn monitoring unit configured to monitor at least one yarn parameter of the produced yarn; and a control system configured to interrupt yarn production upon detection by the yarn monitor of a defined deviation of the monitored yarn parameter from a target value, upon changing bobbins at the winding device, or prior to switching off the spinning machine;

wherein, for the interruption of yarn production, the control system reduces the speed of the delivery device, the take-off device, and the winding device all to a stop in such a manner that an end of the produced yarn is located within the spinning point after the reductions are complete.

* * * * *